United States Patent [19]

Thompson et al.

[11] Patent Number: 4,757,325

[45] Date of Patent: Jul. 12, 1988

[54] METHOD FOR DESIGNING SECTOR BEAM ANTENNAS

[75] Inventors: James D. Thompson, Manhattan Beach; Gregory S. Czuba, San Diego, both of Calif.

[73] Assignee: Hughes Aircraft Company, Los Angeles, Calif.

[21] Appl. No.: 912,702

[22] Filed: Sep. 26, 1986

Related U.S. Application Data

[63] Continuation-in-part of Ser. No. 672,739, Nov. 19, 1984, abandoned.

[51] Int. Cl.[4] ..... H01Q 19/10

[52] U.S. Cl. ..... 343/781 R

[58] Field of Search ..... 343/781 R, 786, 840, 343/DIG. 2, 781 P, 781 CA

[56] References Cited

FOREIGN PATENT DOCUMENTS 1293255 4/1969 Fed. Rep. of Germany ..... 343/840
1067537 6/1954 France ..... 343/781 R
33033 3/1978 Japan ..... 343/840

OTHER PUBLICATIONS

Johnson et al., Antenna Engineering Handbook, McGraw-Hill, New York, 1984, pp. 17-17 to 17-21.

Koch, "Coaxial Feeds for High Aperture Efficiency and Low Spillover of Paraboloidal Reflector Antennas", IEEE Trans. on Antennas and Prop., vol. AP-21, No. 2, Mar. 1973, pp. 164-169.

*Primary Examiner*—William L. Sikes
*Assistant Examiner*—Michael C. Wimer
*Attorney, Agent, or Firm*—S. M. Mitchell; M. J. Meltzer; A. W. Karambelas

[57] ABSTRACT

An improved method for designing sector beam antennas. The method is used to provide a sector beam antenna having a feed horn with a cross sectional azimuth dimension and a cross sectional elevational dimension which are optimized to irradiate a reflector to transmit a signal over a coverage area such that the gain-area-product of the transmitted signal is maximized.

10 Claims, 4 Drawing Sheets

Fig. 3a.
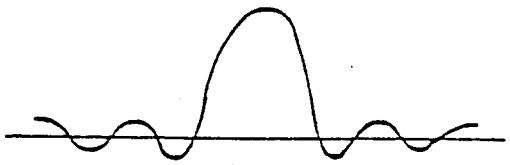
$\frac{J_1(r)}{r}$ ON INFINITE APERTURE
Fig. 3b.
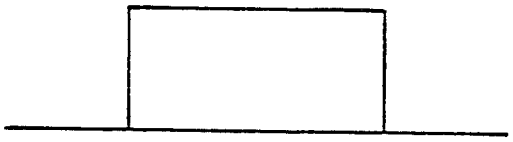
IDEAL SECTOR BEAM
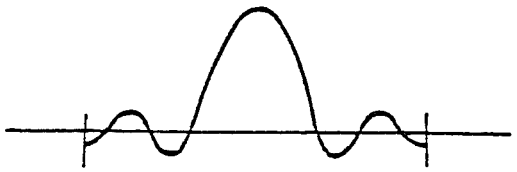
Fig. 4a.
$\frac{J_1(r)}{r}$ ON FINITE APERTURE
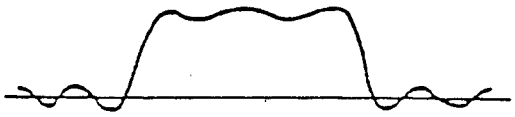
Fig. 4b.
APPROXIMATE IDEAL SECTOR BEAM

METHOD FOR DESIGNING SECTOR BEAM ANTENNAS

REFERENCE TO PARENT APPLICATION

This is a continuation-in-part of application Ser. No. 06/672,739 for High Gain Area Product Antenna Design, filed Nov. 19, 1984 by James D. Thompson and Gregory S. Czuba, now abandoned.

BACKGROUND OF THE INVENTION

1. Field of the Invention

The present invention relates to sector beam antennas. More particularly, the present invention relates to a method for designing a sector beam antenna with a high gain-area-product (GAP).

While the invention is described herein with respect to a particular implementation with reference to an illustrative embodiment, it is understood that the invention is not limited thereto. Those of ordinary skill in the art will recognize additional applications of the teachings provided herein within the scope of the present invention.

2. Description of the Related Art

Where it is necessary to provide area coverage by an antenn, i.e., for communication satellites, it is often desirable to provide the highest possible gain with uniform coverage. In a communication satellite, for example, it may be desirable to provide uniform coverage within a designated area such as the continental United States. Area coverage is currently accomplished using antennas constructed in accordance with conventional design techniques. In some cases, several antennas are used to provide overlapping sector beams. This approach may be somewhat elaborate and require the coordination of a cluster of multiple geosynchronous satellites, i.e., one for each section of the regional area of coverage. See U.S. Pat. No. 4,375,697 to Visher.

Another common solution is to provide a single antenna system with a multiple feed array shaped roughly in proportion to the region intended to be covered. The electromagnetic signal energy is apportioned among the feed elements. The reflector projects a set of overlapping beams in order to attempt to achieve full coverage of the regional area with approximately the same gain factor over the entire area. These systems are typically complex, using computerized assistance to select the optimum arrangement of amplitudes and phases needed to coordinate the excitations. Also, such systems often have high power requirements which may be difficult to achieve in a particular application.

Although it is well known that a useful figure of merit for sector beam antennas is the gain-area-product (GAP), conventional sector beam antennas are designed to maximize the peak gain. (The GAP is the product of the minimum gain of the antenna, in the coverage area, and the angular coverage area of the coverage region.) The *Antenna Engineering Handbook* by H. Jasik 1961 (page 2–14) gives a relationship between gain and beamwidth which results in a theoretical GAP value of 10,600 $deg^2$ for antennas of traditional design. This agrees with current antenna practice, which achieves coverage beams with GAP values ranging from 10,000 to 15,000 $deg^2$. For a theoretically ideal sector beam with uniform gain within the coverage region and with no gain outside the coverage region, the GAP is 41,253 $deg^2$. Thus, current practice produces antenna beams with GAP values of 25% to 35% of the maximum achievable gain-area-product.

SUMMARY OF THE INVENTION

The shortcoming illustrated by the related art are addressed by the present invention which provides an improved method for designing a sector beam antenna to maximize the gain-area-product thereof. The method is used to provide a sector beam antenna having a feed horn with a cross sectional azimuth dimension $d_A$ and a cross sectional elevational dimension $d_E$ which are optimized to irradiate a reflector having a cross sectional diameter D, so as to transmit a signal having a fundamental frequency f of wavelength L over a coverage area A such that the gain-area-product thereof is maximized. The azimuth beamwidth for the coverage area is $B_A$ and the desired elevation beamwidth for the coverage area is $B_E$. The method of the invention includes the steps of:

(a) dividing the reflector diameter D by the wavelength L to obtain a ratio D/L;

(b) multiplying the azimuth beamwidth $B_A$ by the ratio D/L to obtain a first product equal to $B_AD/L$;

(c) multiplying the elevation beamwidth $B_E$ by the ratio D/L to obtain a second product equal to $B_ED/L$;

(d) ascertaining the value of a first index $K_A$ from said first product, which is proportional to the primary energy distribution of the feed horn in azimuth and provides a measure of the extent to which sidelobes of the signal, radiated in azimuth as part of the primary pattern from the feed horn, irradiate the reflector as a function of an angle $O_A$ between a first line from the center of the feed horn to the center of the reflector and a second line from the center of the feed horn to the edge of the reflector in the azimuth direction;

(e) ascertaining the value of a second index $K_E$ from said second product, which is proportional to the primary energy distribution of the feed horn in elevation and provides a measure of the extent to which sidelobes of the signal, radiated in elevation as part of the primary pattern from the feed horn, irradiate the reflector as a function of a second angle $O_E$ between the line from the center of the feed horn to the center of the reflector and a third line from the center of the feed horn to an edge of the reflector in the elevation direction;

(f) determining the azimuth dimension $d_A$ of the feed horn from the value of the index $K_A$ which provides a first gain-line-product of the feed horn aperture radiation pattern in azimuth; and (g) determining the elevational dimension $d_E$ of the feed horn from the value of the index $K_E$ which provides a second gain-line-product of the feed horn aperture radiation pattern in elevation.

In a specific embodiment, the invention provides a method of ascertaining the values of the K indices which includes the steps of creating a graph of the K indices as a function of the BD/L products over a range of values thereof by applying a known radiation pattern to the reflector and measuring the width of the reflected beam. The values of K for a given product are then simply read from the graph.

BRIEF DESCRIPTION OF THE DRAWINGS

FIGS. 3*a* and 3*b* show an ideal distribution and corresponding ideal sector beam respectively.

FIGS. 4*a* and 4*b* show a truncated distribution and corresponding sector beam respectively.

DESCRIPTION OF THE INVENTION

Figure 1:
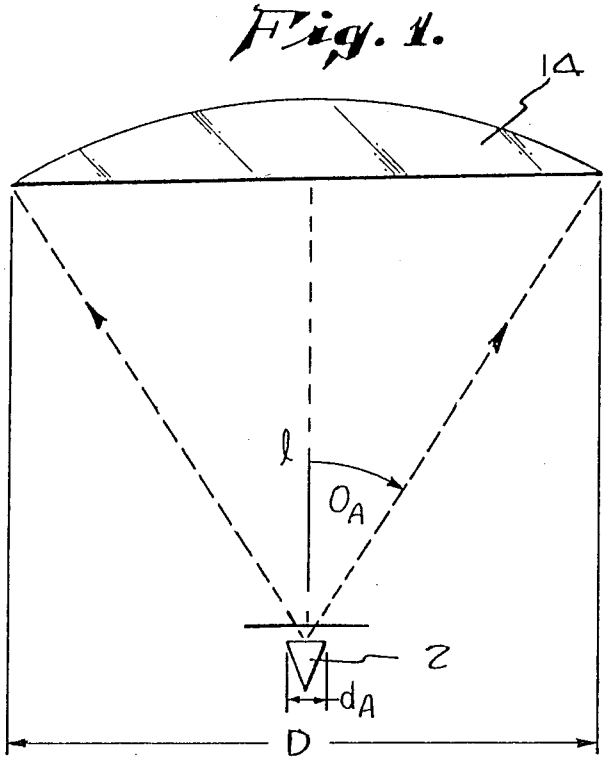
FIG. 1 shows a simplified top plan view of a conventional sector beam antenna.

FIG. 1 shows a simplified top plan view of a conventional sector beam antenna 10 having a feed horn 12 and a reflector dish 14. The feed horn 12 is aligned with the reflector 14 so that energy radiated in a primary radiation pattern therefrom will irradiate the reflector 14. That is, the boresight of the feed horn 12, emanating from the center thereof, is coaxial with the reflector 14. (It is known that the feed horn 12 may be off axis relative to the reflector 14. It is similarly, immaterial to conventional systems or to the present invention whether a single dish antenna such as that shown in FIG. 1 is used of an array or reflectors.)

Figure 2:
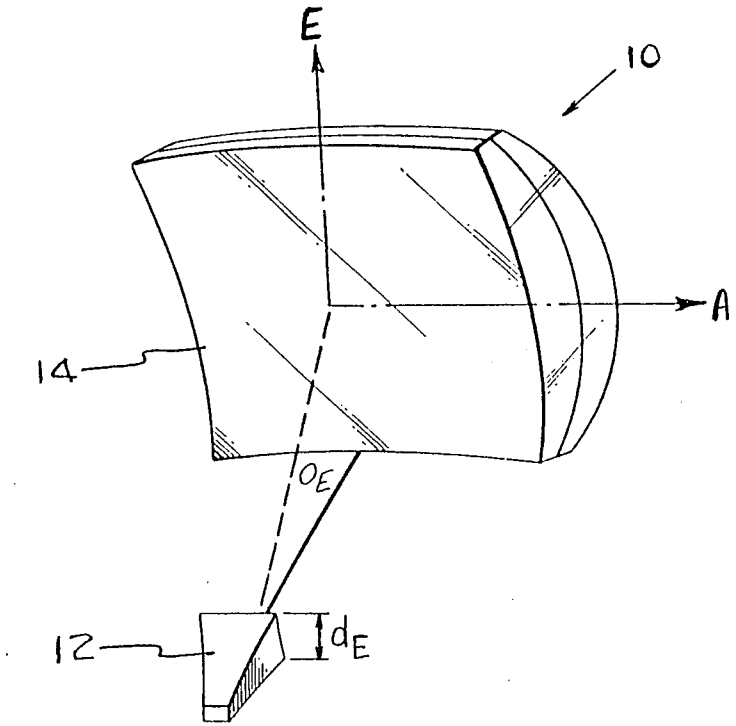
FIG. 2 shows a perspective view of the conventional sector beam antenna of FIG. 1.

To facilitate the description of the present invention, the cross-sectional azimuth dimension '$d_A$' of the feed horn 12 and the cross-sectional diameter 'D' of the reflector 14 are shown in FIG. 1. Also shown is the angle $O_A$ between the line from the center of the feed horn 12 and the center of the reflector 14 and a second line from the center of the feed horn 12 to the edge of the reflector 14. The sector beam antenna 10 is shown in perspective in FIG. 2 where the cross-sectional elevational dimension '$d_E$' and the elevation angle $O_E$ are shown.

In general and as mentioned above, the related art teaches a design of sector beam antennas to maximize the peak gain. The method of the present invention teaches a design of sector beam antennas to maximize the gain-area-product of the reflected beam.

Thus, for an illustrative rectangular shaped beam, the design technique of the present invention begins with several conventional preliminary steps including, first, selection of a reflector diameter D. This parameter is usually set by other, typically physical, satellite design constraints. Next, the operating frequency f is chosen. This is often given as a range with the center frequency thereof used for the design of the antenna. From the frequency f, the wavelength L is known as c/f, where c is the velocity of propagation. Since the coverage area 'A' is typically given also, and the orbital distance of the satellite is known, e.g., approximately 23,400 miles for synchronous orbit, the desired azimuth beamwidth $B_A$ and the desired elevation beamwidth $B_E$ are known. For the continental United States (CONUS), for example, the azimuth beamwidth $B_A$ is typically 6 degrees and the elevation beamwidth $B_E$ is typically 3 degrees.

For the illustrative rectangular shaped beam, the improved sector beam antenna design technique of the present invention includes, the additional steps of:

(a) dividing the reflector diameter D by the wavelength L to obtain a ratio D/L;

(b) multiplying the azimuth beamwidth $B_A$ by the ratio D/L to obtain a first product equal to $B_AD/L$;

(c) multiplying the elevation beamwidth $B_E$ by the ratio D/L to obtain a second product equal to $B_ED/L$;

(d) ascertaining the value of a first index $K_A$ from said first product, which is proportional to the primary energy distribution of the feed horn 12 in azimuth and provides a measure of the extent to which sidelobes of the signal, radiated in azimuth as part of the primary pattern from the feed horn 12, irradiate the reflector 14, as a function of an angle $O_A$ between the first line from the center of the feed horn 12 to the center of the reflector 14 and a second line from the center of the feed horn 12 to the edge of the reflector 14 in the azimuth direction;

(e) ascertaining the value of a second index $K_E$ from said second product, which is proportional to the primary energy distribution of the feed horn 12 in elevation and provides a measure of the extent to which sidelobes of the signal, radiated in elevation as part of the primary pattern from the feed horn 12, irradiate the reflector 14, as a function of a second angle $O_E$ between the line from the center of the feed horn 12 to the center of the reflector 14 and a third line from the center of the feed horn to an edge of the reflector in the elevation direction;

(f) determining the azimuth dimension $d_A$ of the feed horn 12 from the value of the index $K_A$ which provides a first gain-line-product of the feed horn radiation pattern in azimuth; and (g) determining the elevational dimension $d_E$ of the feed horn 12 from the value of the index $K_E$ which provides a second gain-line-product of the feed horn aperture radiation pattern in elevation.

From basic aperture theory as applied to the ideal sector beam, a circular ideal sector beam is formed when a circularly symmetric distribution of the form $2J_1(r)/r$ is put on a circular aperture of infinite extent. In this formulation r is the radial coordinate and $J_1(r)$ is a Bessel function of order 1. This distribution and the resulting beam are shown in FIGS. 3*a* and 3*b* respectively. While an infinite aperture is not realizable in a practical sense, truncated versions of this same aperture distribution on a finite aperture result in beam shapes which closely approximate the ideal sector beam. A truncated distribution and resulting beam are shown in FIGS. 4*a* and 4*b* respectively. In general, the approximation to the ideal sector beam improves as the aperture grows radially to encompass more of the distribution function before truncation occurs. The design technique of the present invention incorporates these principles which are applied, in the illustrative embodiment to a rectangular aperture 12. Thus, the indices $K_A$ and $K_E$ relate to the antenna parameter 'mu' which is a measure of the amount of the distribution function $2J_1(r)/r$ which is contained on the reflector 14. and is given by equation 1:

$$mu=(pi)(d/L)\sin 0 \quad (1)$$

By removing the constant pi from the equation, the zero crossings of mu occur at integer multiples of d as opposed to integer multiples of pi. Thus, the parameter K, which is also a measure of distribution function contained on the aperture, is defined as:

$$K=mu/pi=(d/L)\sin 0. \quad (2)$$

Equation 2 may be solved for the feed horn aperture diameter d:

$$d=KL/\sin 0 \quad (3)$$

As will be evident to one of ordinary skill in the art, for a particular distribution, where K or mu is known, the necessary aperture size d may be determined.

Where, as is typical, the aspect ratio between the focal length l and the diameter D of the reflector 14 is such that the angles $O_A$ and $O_E$ are 30 degrees, d is equal to KL/2.

Figure 5:
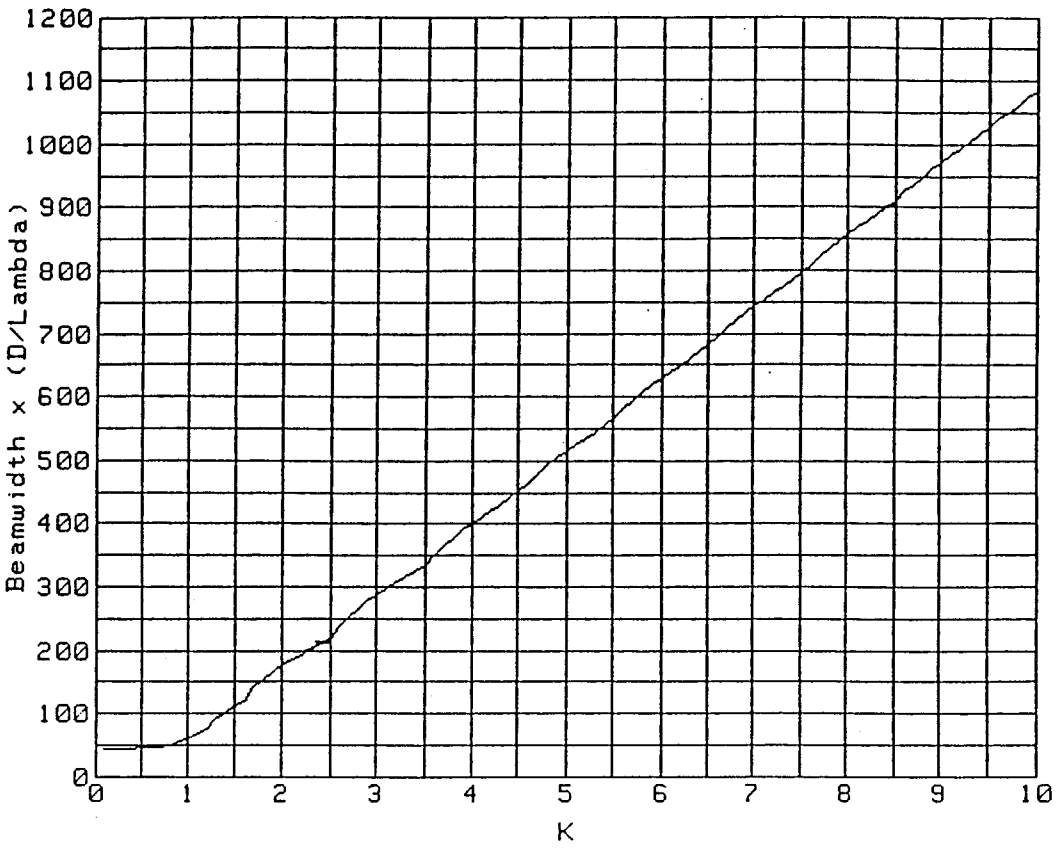
FIG. 5 shows the scaling factor K as a function of the beamwidth diameter over wavelength product.

For the present invention, a correlation between the product of the beamwidth $B_A$ or $B_E$ was determined by empirical analysis to generate the graph of FIG. 5. FIG. 5 shows BD/L products as a function of K for a single feed horn having a practically uniform distribution. The data for the graph was generated by applying a radiation pattern to the reflector 14 representing a known value of K and measuring the gain and beamwidth characteristics of the resulting beam.

In operation, assume that an application requires a Ku band antenna to cover the continental United States. Assume further that a reflector antenna is used for which a typical diameter is approximately 100 inches. At Ku band, L is approximately 1 inch. As mentioned above, the beamwidths $B_A$ and $B_E$ to cover CONUS are 6 degrees and 3 degrees respectively. Accordingly, the azimuth (first) product and the elevational (second) product are respectively:

$$B_A D/L = 6 \times 100/1 = 600$$

and $$B_E D/L = 3 \times 100/1 = 300.$$

From FIG. 5, $K_A$ and $K_E$ are read as 5.75 and 3.1 respectively. Using equation 3 and assuming the typical 30 degree aspect ratio, mentioned above, yields:

$$d_A = 2.875 \text{ inches and } d_E = 1.55 \text{ inches.}$$

Hence the dimensions of the feed horn 12 are determined.

Figure 6:
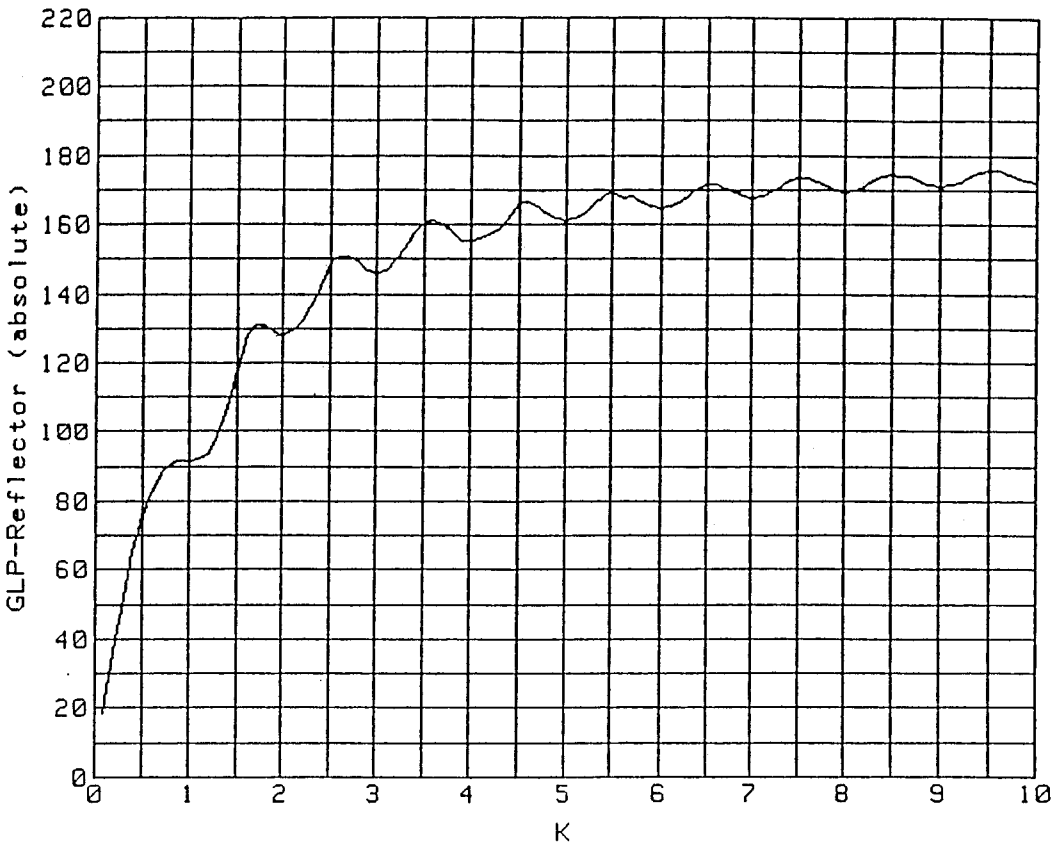
FIG. 6 shows gain-area-product as a function of the scaling parameter K.

Moreover, with the dimensions of the feed horn 12, the performance of the antenna 10 may be predicted and it is substantially higher than those indicated above for antennas designed using the teachings of the related art. That is, FIG. 6 shows the gain-line-product GLP versus K for a single feed horn having a practically uniform distribution. (The data of FIG. 6 was obtained by parametric study. The appropriate mathematical expressions associated with this process were obtained from *Microwave Antenna Theory and Design* by S. Silver.) Thus, $GLP_A$ corresponding to a $K_A$ of 5.75 is read as approximately 166 while $GLP_E$ corresponding to a $K_E$ of 3.1 is similarly read as 147. Accordingly, the gain-area-product (GAP) is the product of $GLP_A$ and $GLP_E$:

$$GAP = (GLP_A)(GLP_E) = 166 \times 147 = 24{,}402 \text{ deg}^2.$$

This compares to GAP values in the range of 10,000 to 15,000 for the sector beam antennas of conventional design. In addition, given the maximum attainable GAP value of 41,253 $\text{deg}^2$ from above, the maximum attainable GLP is the square root of the maximum GAP or 203. Thus, the efficiencies in terms of GAP values for the antenna designed in accordance with the teachings of the present invention are 166/203 or 82% in azimuth and 72% in elevation.

While the present invention has been described herein with reference to an illustrative embodiment it is understood that the invention is not limited thereto. Those of ordinary skill in the art will recognize additional modifications and embodiments within the scope thereof. For example, the invention is not limited to any particular technique for ascertaining the amount of the radiated energy that irradiates the reflector as part of the primary radiation pattern. Other techniques within the scope of the invention may be employed as is known in the art.

It is intended by the appended claims to cover any and all modifications, applications and embodiments within the scope of the present invention. Thus,

What is claimed is:

1. An improved method for designing a sector beam antenna to maximize the gain-area-product thereof, said sector beam antenna having a feed horn with a cross sectional azimuth dimension $d_A$ and a cross sectional elevational dimension $d_E$ which irradiates a reflector having a cross sectional diameter D, said sector beam antenna effective to transmit a signal having a fundamental frequency f of wavelength L over a coverage area A from a known distance such that the desired azimuth beamwidth for the coverage area is $B_A$ and the desired elevation beamwidth for the coverage area is $B_E$, said improved method including the steps of:

(a) dividing the reflector diameter D by the wavelength L to obtain a ratio D/L;

(b) multiplying the azimuth beamwidth $B_A$ by the ratio D/L to obtain a first product equal to $B_A D/L$;

(c) multiplying the elevation beamwidth $B_E$ by the ratio D/L to obtain a second product equal to $B_E D/L$;

(d) ascertaining the value of a first index $K_A$ from said first product, which is proportional to the primary energy distribution of the feed horn in azimuth and provides a measure of the extent to which sidelobes of the signal, radiated in azimuth as part of the primary pattern from the feed horn, irradiate the reflector as a function of an angle $O_A$ between a first line from the center of the feed horn to the center of the reflector and a second line from the center of the feed horn to the edge of the reflector in the azimuth direction;

(e) ascertaining the value of a second index $K_E$ from said second product, which is proportional to the primary energy distribution of the feed horn in elevation and provides a measure of the extent to which sidelobes of the signal, radiated in elevation as part of the primary pattern from the feed horn, irradiate the reflector as a function of a second angle $O_E$ between said line from the center of the feed horn to the center of the reflector and a third line from the center of the feed horn to an edge of the reflector in the elevation direction;

(f) determining the azimuth dimension $d_A$ of the feed horn from the value of the index $K_A$ which provides a first gain-line-product of the feed horn radiation pattern in azimuth; and (g) determining the elevational dimension $d_E$ of the feed horn from the value of the index $K_E$ which provides a second gain-line-product of the feed horn aperture radiation pattern in elevation.

2. The improved method for designing a sector beam antenna of claim 1 including the step of creating a graph of the index $K_A$ as a function of said first product over a range of values of said first product prior to the step (d) of ascertaining the value of a first index $K_A$ from said first product.

3. The improved method for designing a sector beam antenna of claim 2 wherein said step (d) of ascertaining the value of a first index $K_A$ from said first product includes the step of reading the value of $K_A$ from said graph corresponding to the value of said first product.

4. The improved method for designing a sector beam antenna of claim 1 including the step of creating a graph of the index $K_E$ as a function of said second product over a range of values of said second product prior to the step (e) of ascertaining the value of a second index $K_E$ from said second product.

5. The improved method for designing a sector beam antenna of claim 4 wherein said step (e) of ascertaining the value of a second index $K_E$ from said second product includes the step of reading the value of $K_E$ from said graph corresponding to the value of said first product.

6. An improved method for designing a sector beam antenna to maximize the gain-line-product thereof, said sector beam antenna having a feed horn with a cross sectional dimensional 'd' and which irradiates a reflector having a cross sectional diameter D, said sector beam antenna effective to transmit a signal having a fundamental frequency f of wavelength L over a coverage area A from a known distance such that a desired beamwidth for the coverage area is B, said improved method including the steps of:

(a) dividing the reflector diameter D by the wavelength L to obtain a ratio D/L;

(b) multiplying the beamwidth B by the ratio D/L to obtain a product equal to BD/L;

(c) ascertaining the value of an index K from said product, which is proportional to the primary energy distribution of the feed horn and provides a measure of the extent to which sidelobes of the signal radiated as part of the primary pattern from the feed horn, irradiate the reflector as a function of the angle O between a first line from the center of the feed horn to the center of the reflector and a second line from the center of the feed horn to an edge of the reflector;

(d) determining the dimension 'd' of the feed horn from the value of the index K which provides a maximum gain-line-product of the feed horn aperture radiation pattern.

7. The improved method for designing a sector beam antenna of claim 6 including the step of creating a graph of the index K as a function of said product over a range of values of said product prior to the step of ascertaining the value of said index K from said product.

8. The improved method for designing a sector beam antenna of claim 7 wherein said step of ascertaining the value of said index K from said product includes the step of reading the value of K from said graph corresponding to the value of said product.

9. The improved method for designing a sector beam antenna of claim 7 wherein said step of creating a graph of the index K as a function of said product over a range of values of said product includes the step of applying a known radiation pattern to said reflector corresponding to each value of K in a range and measuring the width of the reflected beam.

10. The improved method for designing a sector beam antenna of claim 6 wherein said step (d) for determining the dimension 'd' of the feed horn from the value of the index K which provides a maximum gain-line-product of the feed horn aperture radiation pattern, includes the step of solving the equation $K=d/2L$ for d.

* * * * *

UNITED STATES PATENT AND TRADEMARK OFFICE

CERTIFICATE OF CORRECTION

PATENT NO. : 4,757,325

DATED : 12 July 1988

INVENTOR(S) : James D. Thompson, et al

It is certified that error appears in the above—identified patent and that said Letters Patent is hereby corrected as shown below:

Column 5, line 33, rewrite "$d_A$=2.875 inches and $d_E$=1.55 inches" as -$d_A$=11.5 inches and $d_E$=6.2 inches-.

Signed and Sealed this

Sixth Day of December, 1988

*Attest:*

DONALD J. QUIGG

*Attesting Officer*

*Commissioner of Patents and Trademarks*